US009589516B2

(12) United States Patent
Pyun et al.

(10) Patent No.: US 9,589,516 B2
(45) Date of Patent: Mar. 7, 2017

(54) METHOD OF DRIVING A DISPLAY PANEL INCLUDING POLARITY INVERSION, DISPLAY PANEL DRIVING APPARATUS FOR PERFORMING THE METHOD AND DISPLAY APPARATUS HAVING THE DISPLAY PANEL DRIVING APPARATUS

(71) Applicant: Samsung Display Co., Ltd., Yongin (KR)

(72) Inventors: Ki-Hyun Pyun, Goyang-si (KR); Seung-Woon Shin, Asan-si (KR); Jong-Young Yun, Gwangmyeong-si (KR); Bong-Chool Jeon, Cheonan-si (KR); Jun-Ho Hwang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 66 days.

(21) Appl. No.: 14/276,668

(22) Filed: May 13, 2014

(65) Prior Publication Data

US 2015/0170589 A1 Jun. 18, 2015

(30) Foreign Application Priority Data

Dec. 16, 2013 (KR) ..... 10-2013-0156205

(51) Int. Cl.
*G09G 5/00* (2006.01)
*G09G 3/36* (2006.01)

(52) U.S. Cl.
CPC ..... *G09G 3/3614* (2013.01); *G09G 3/3688* (2013.01); *G09G 3/3607* (2013.01); *G09G 2320/0204* (2013.01); *G09G 2340/16* (2013.01)

(58) Field of Classification Search
CPC ..... G09G 3/3614; G09G 3/3607; G09G 2340/16; G09G 3/3648; G09G 2320/0204
USPC ..... 345/208
See application file for complete search history.

(56) References Cited

U.S. PATENT DOCUMENTS

| | | | | |
|---|---|---|---|---|
| 8,102,351 | B2 | 1/2012 | Tang | |
| 2005/0285837 | A1 | 12/2005 | Akimoto | |
| 2007/0146279 | A1* | 6/2007 | Oke | G09G 3/3614 345/94 |
| 2009/0251451 | A1 | 10/2009 | Cha et al. | |
| 2011/0156752 | A1* | 6/2011 | Sofer | G06F 1/08 326/52 |
| 2011/0221972 | A1 | 9/2011 | Kawabata et al. | |
| 2011/0310136 | A1* | 12/2011 | Im | G09G 3/3413 345/690 |
| 2012/0169720 | A1* | 7/2012 | Moh | H04N 13/0025 345/419 |

(Continued)

FOREIGN PATENT DOCUMENTS

| | | |
|---|---|---|
| KR | 10-1999-0047243 | 7/1999 |
| KR | 10-0909049 | 7/2009 |
| KR | 10-1283974 | 7/2013 |

*Primary Examiner* — Jonathan Blancha
(74) *Attorney, Agent, or Firm* — H.C. Park & Associates, PLC

(57) ABSTRACT

A method of driving a display panel, the method including outputting video data to a display panel during an N-th (N is a natural number) frame, outputting video data to the display panel during an (N+1)-th frame, comparing polarities of video data of the N-th frame and corresponding polarities of video data of the (N+1)-th frame, and controlling polarities of video data of an (N+2)-th frame, according to the result of the comparison.

16 Claims, 17 Drawing Sheets

(56) References Cited

U.S. PATENT DOCUMENTS

2014/0071184 A1* 3/2014 Lu ..... G09G 3/36
345/690

* cited by examiner

METHOD OF DRIVING A DISPLAY PANEL INCLUDING POLARITY INVERSION, DISPLAY PANEL DRIVING APPARATUS FOR PERFORMING THE METHOD AND DISPLAY APPARATUS HAVING THE DISPLAY PANEL DRIVING APPARATUS

PRIORITY STATEMENT

This application claims priority from and the benefit of Korean Patent Application No. 10-2013-0156205, filed on Dec. 16, 2013, which is hereby incorporated by reference for all purposes as if fully set forth herein.

BACKGROUND

Field

Exemplary embodiments of the present inventive concept relate to a method of driving a display panel, a display panel driving apparatus for performing the method, and a display apparatus having the display panel driving apparatus. More particularly, exemplary embodiments of the present inventive concept relate to a method of driving a display panel inverting a polarity of a data signal and a display panel driving apparatus for performing the method, and a display apparatus having the display panel driving apparatus.

Discussion of the Background

A liquid crystal display panel of a liquid crystal display apparatus includes a lower substrate, an upper substrate and a liquid crystal layer. The lower substrate includes a thin film transistor and a pixel electrode. The upper substrate includes a common electrode. The liquid crystal layer is interposed between the lower substrate and the upper substrate, and includes a liquid crystal of which alignment is changed by an electric field between a pixel voltage applied to the pixel electrode and a common voltage applied to the common electrode.

When data signals having the same polarity are consistently applied to the pixel electrode, the liquid crystal is deteriorated. An inversion method, which inverts the polarity of the data signal with respect to a reference voltage, has been developed so as to prevent the deterioration of the liquid crystal.

A column inversion method of the inversion method inverts the polarity of the data signal with respect to the reference voltage by a column. Specifically, polarities of data signals applied to adjacent data lines are opposite from each other. In addition, a polarity of a data signal applied to the same data line is inverted in a frame period.

However, when a video is displayed on the liquid crystal display panel displaying an image, at least a portion of an image block of the video may have the same polarity in the frame period. Therefore, a vertical line pattern may be displayed in the image, and thus display quality of the liquid crystal display apparatus may be decreased.

The above information disclosed in this Background section is only for enhancement of understanding of the background of the invention and therefore it may contain information that does not form any part of the prior art nor what the prior art may suggest to a person of ordinary skill in the art.

SUMMARY OF THE INVENTIVE CONCEPT

Exemplary embodiments of the present invention provide a method of driving a display panel capable of improving display quality of a display apparatus.

Exemplary embodiments of the present invention also provide a display panel driving apparatus for performing the above-mentioned method.

Additional features of the invention will be set forth in the description which follows, and in part will be apparent from the description, or may be learned by practice of the invention.

An exemplary embodiment of the present invention discloses a method of driving a display panel, the method including outputting video data to a display panel during an N-th (N is a natural number) frame, outputting video data to the display panel during an (N+1)-th frame, comparing polarities of video data of the N-th frame with corresponding polarities of video data of the (N+1)-th frame, and controlling polarities of video data of an (N+2)-th frame, according to the result of the comparison.

An exemplary embodiment of the present invention discloses a display panel driving apparatus, including a gate driver configured to output a gate signal to a gate line of a display panel including the gate line and a data line, and a data driver configured to output a video data to the display panel during an N-th (N is a natural number) frame and an (N+1)-th frame, comprising a video polarity controlling part configured to compare polarities of the video data of the N-th frame with corresponding polarities of the video data of the (N+1)-th frame, and a data driving integrated circuit part configured to control polarities of the video data displayed on the display panel during an (N+2)-th frame.

An exemplary embodiment of the present invention also discloses a display apparatus, including a display panel a display panel configured to display an image, comprising a gate line and a data line, and a display panel driving apparatus comprising a gate driver configured to output a gate signal to the gate line, and a data driver configured to output a video data to the display panel during an N-th (N is a natural number) frame and an (N+1)-th frame, comprising a video polarity controller configured to compare polarities of the video data of the N-th frame and corresponding polarities of the video data of the (N+1)-th frame, and a data driving integrated circuit configured to control polarities of the video data displayed on the display panel during an (N+2)-th frame.

According to the present inventive concept, a video data may have different polarities in adjacent frames, therefore a vertical line phenomenon of a display panel may be prevented. Thus, display quality of a display apparatus including the display panel may be improved.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
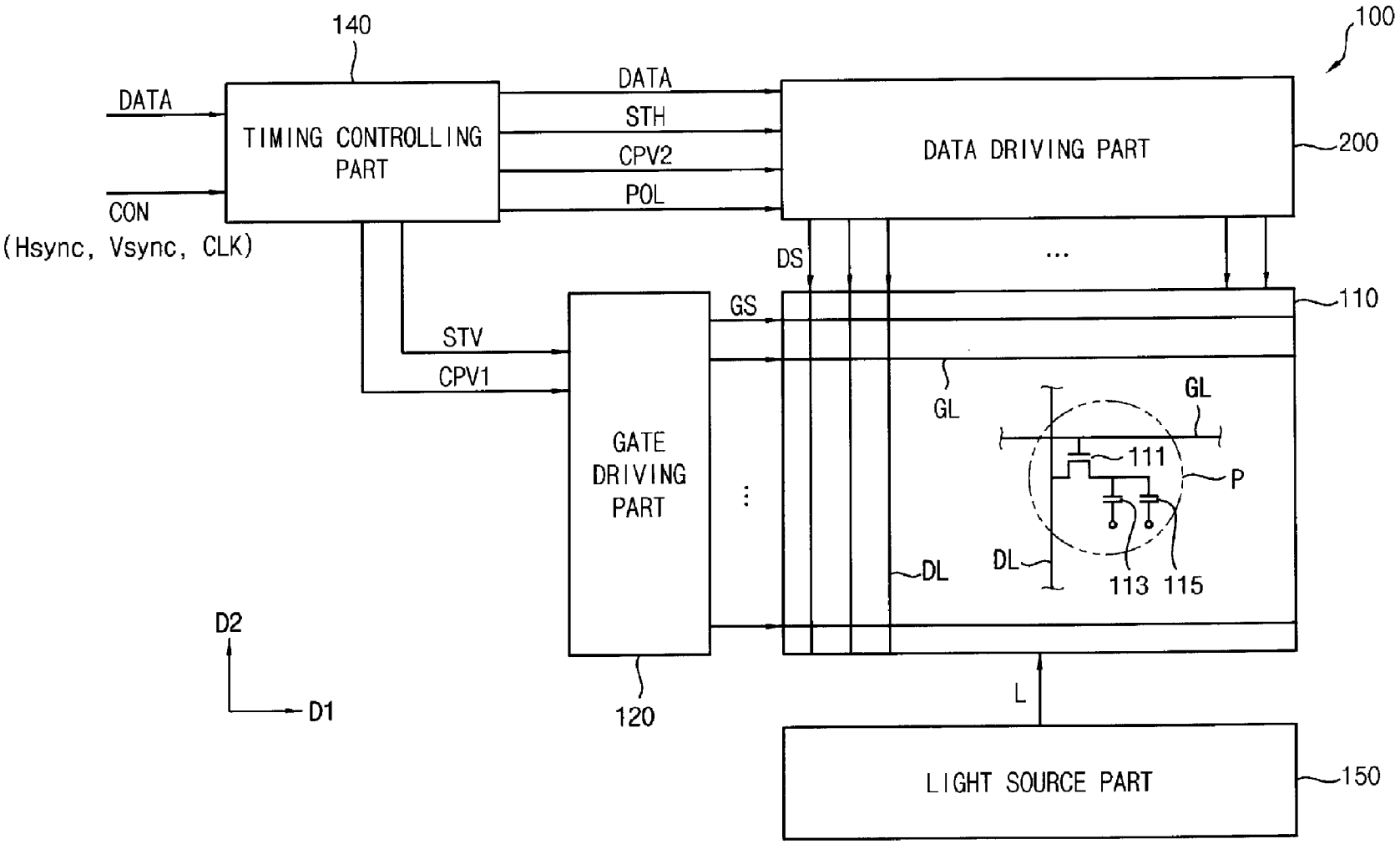
FIG. 1 is a block diagram illustrating a display apparatus according to an exemplary embodiment of the present inventive concept.

Hereinafter, the present inventive concept will be explained in detail with reference to the accompanying drawings. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram illustrating a display apparatus according to an exemplary embodiment of the present inventive concept.

Referring to FIG. 1, the display apparatus according to the present exemplary embodiment includes a display panel 110, a gate driving part 120, a data driving part 200, a timing controlling part 140 and a light source part 150. The gate driving part 120, the data driving part 200 and the timing controlling part 140 may be defined as a display panel driving apparatus driving the display panel 110.

The display panel 110 receives a data signal DS based on an image data DATA to display an image. For example, the image data DATA may be two-dimensional plane image data. Alternatively, the image data DATA may include a left-eye image data and a right-eye image data for displaying a three-dimensional stereoscopic image.

The display panel 110 includes gate lines GL, data lines DL and a plurality of unit pixels P. The gate line GL extends in a first direction D1 and the data line DL extends in a second direction D2 substantially perpendicular to the first direction D1. The first direction D1 may be parallel with a long side of the display panel 110 and the second direction D2 may be parallel with a short side of the display panel 110. Each of the unit pixels P includes a thin film transistor 111 electrically connected to the gate line GL and the data line DL, a liquid crystal capacitor 113 and a storage capacitor 115 connected to the thin film transistor 111. Thus, the display panel 110 may be a liquid crystal display panel, and the display apparatus 100 including the display panel 110 may be a liquid crystal display apparatus.

The gate driving part 120 generates a gate signal GS in response to a gate start signal STV and a gate clock signal CPV1 provided from the timing controlling part 140, and outputs the gate signal GS to the gate line GL.

The data driving part 200 outputs the data signal DS based on the image data DATA to the data line DL in response to a data start signal STH and a data clock signal CPV2 provided from the timing controlling part 140.

In addition, the data driving part 200 controls a polarity of the data signal DS according to a polarity control signal POL provided from the timing controlling part 140. Specifically, the data driving part 200 drives the display panel 110 in a column inversion method. Thus, data signals DS having different polarities are applied to adjacent data lines DL. In addition, the polarity of the data signals DS may be inverted in a frame period. However, polarities of the data signals DS of a preset frame and polarities of the data signals DS of a next frame with respect to a video data displaying a video may be different from each other. Thus, the polarity of the data signals DS may not be inverted in the frame period.

The timing controlling part 140 receives the image data DATA and a control signal CON from an outside. The control signal CON may include a horizontal synchronous signal Hsync, a vertical synchronous signal Vsync and a clock signal CLK. The timing controlling part 140 generates the data start signal STH using the horizontal synchronous signal Hsync and outputs the data start signal STH to the data driving part 200. In addition, the timing controlling part 140 generates the gate start signal STV using the vertical synchronous signal Vsync and outputs the gate start signal STV to the gate driving part 120. In addition, the timing controlling part 140 generates the gate clock signal CPV1 and the data clock signal CPV2 using the clock signal CLK, and outputs the gate clock signal CPV1 to the gate driving part 120 and outputs the data clock signal CPV2 to the data driving part 200.

The light source part 150 provides light L to the display panel 110. For example, the light source part 150 may include a light emitting diode (LED).

Figure 2A:
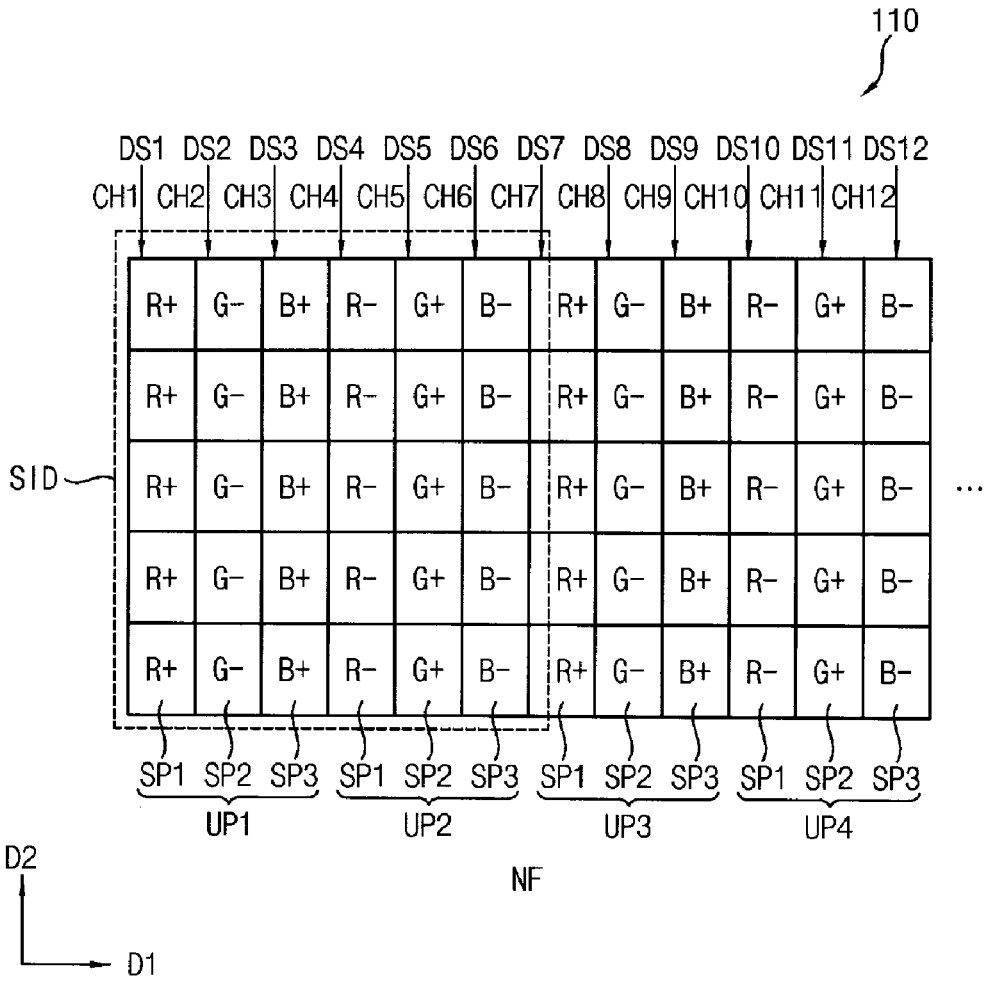
FIGS. 2A and 2B are plan views illustrating a display panel of FIG. 1 displaying a static image.
Figure 2B:
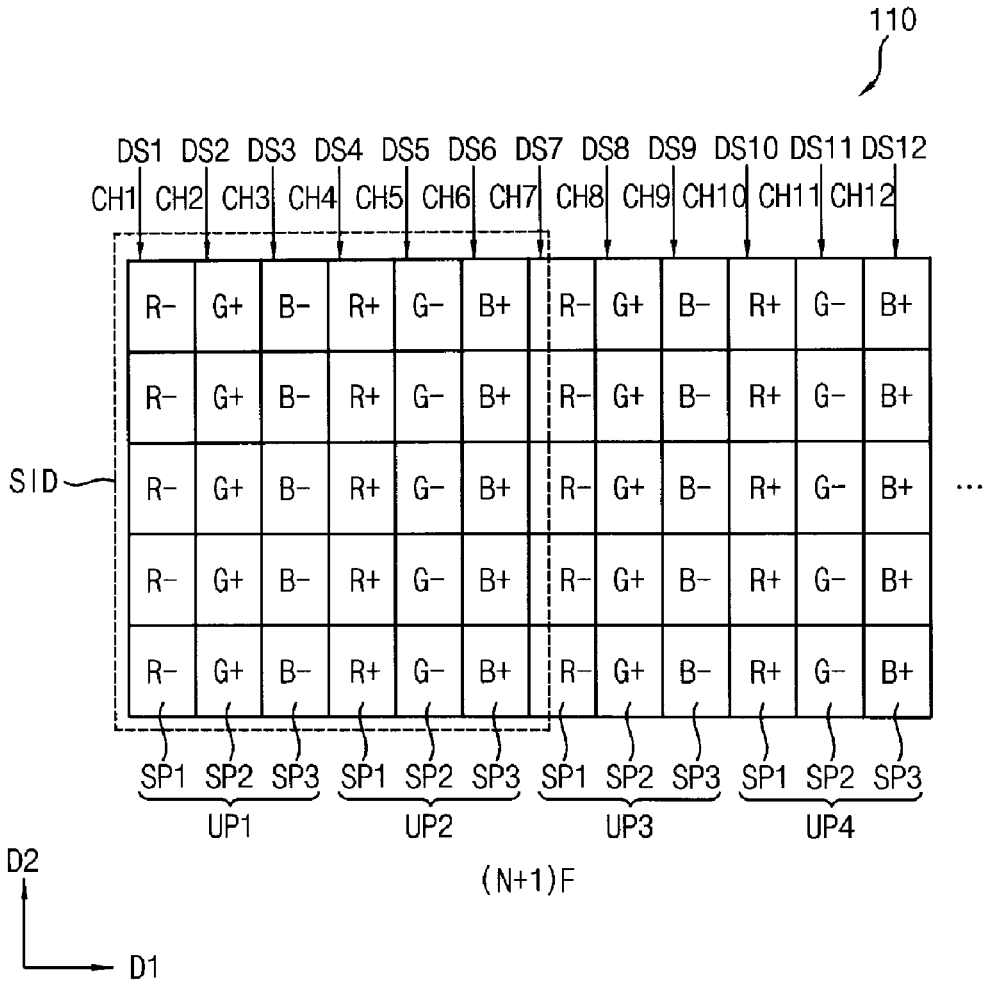

FIGS. 2A and 2B are plan views each illustrating the display panel 110 of FIG. 1 displaying a static image during an N-th frame (N is a natural number) NF and an (N+1)-th frame (N+1)F.

Referring to FIGS. 1, 2A, and 2B, the display panel 110 may include first to fourth unit pixels UP1, UP2, UP3, and UP4, each of the first to fourth unit pixels UP1, UP2, UP3, and UP4 includes a first sub pixel SP1, a second sub pixel SP2 and a third sub pixel SP3. Thus, the display panel 110 may receive first to twelfth data signals DS1, DS2, . . . , and DS12 through first to twelfth data channels CH1, CH2, . . . , and CH12. For example, the first sub pixel SP1 may be a red sub pixel, the second sub pixel SP2 may be a green sub pixel and the third sub pixel SP3 may be a blue sub pixel.

The display panel 110 may display static image data SID. The static image data SID may correspond to a plurality of unit pixels. For example, the static image data SID may include data corresponding to the first unit pixel UP1 and the second unit pixel UP2 during an N-th frame (N is a natural number) NF, and may include data corresponding to the first unit pixel UP1 and the second unit pixel UP2 during an (N+1)-th frame (N+1)F. Thus, the static image data SID may be displayed on the display panel 110 by the first to sixth data signals DS1, DS2, . . . , and DS6 during the N-th frame NF and the (N+1)-th frame (N+1)F.

The display panel 110 is driven in the column inversion method. For example, data signals DS having positive polarities may be applied to odd-numbered data lines DL and data signals DS having negative polarities may be applied to even-numbered data lines DL. Thus, the first data signal DS1 applied to the first data line DL1 through the first data channel CH1 may have the positive polarity, the second data signal DS2 applied to the second data line DL2 through the second data channel CH2 may have the negative polarity, the third data signal DS3 applied to the third data line DL3 through the third data channel CH3 may have the positive polarity, and the fourth data signal DS4 applied to the fourth data line DL4 through the fourth data channel CH4 may have the negative polarity.

The polarities of the data signals DS are inverted in the frame period. For example, in case the data signals DS having the positive polarities are applied to the odd-numbered data lines DL and the data signals DS having the negative polarities are applied to the even-numbered data lines DL during the N-th frame NF, the data signals DS having the negative polarities are applied to the odd-numbered data lines DL and the data signals DS having the positive polarities are applied to the even-numbered data lines DL during the (N+1)-th frame (N+1)F. Thus, the first data signal DS1 applied to the first data line through the first data channel CH1 may have the negative polarity, the second data signal DS2 applied to the second data line through the second data channel CH2 may have the positive polarity, the third data signal DS3 applied to the third data line DL3 through the third data channel CH3 may have the negative polarity, and the fourth data signal DS4 applied to the fourth data line DL4 through the fourth data channel CH4 may have the positive polarity.

Figure 3:
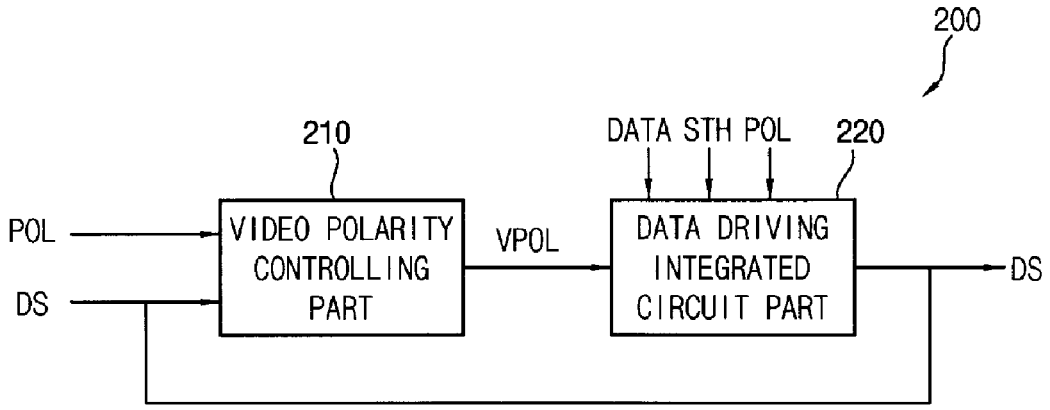
FIG. 3 is a block diagram illustrating a data driving part of FIG. 1.

FIG. 3 is a block diagram illustrating the data driving part 200 of FIG. 1.

Referring to FIGS. 1, 2A, 2B, and 3, the data driving part 200 includes a video polarity controlling part 210 and a data driving integrated circuit part 220.

The video polarity controlling part 210 controls a polarity of the video data for displaying the video of the image data DATA on the display panel 110. Specifically, the video polarity controlling part 210 receives the polarity control signal POL provided from the timing controlling part 140 and the data signal DS outputted from the data driving integrated circuit 220, and outputs a video polarity control signal VPOL controlling the polarity of the video data according to the polarity control signal POL and the data signal DS. The data signal DS applied to the video polarity controlling part 210 may include the data signal DS of the N-th frame NF and the (N+1)-th frame (N+1)F.

The data driving integrated circuit part 220 receives the image data DATA, the data start signal STH and the polarity control signal POL from the timing controlling part 140, receives the video polarity control signal VPOL from the video polarity controlling part 210, and outputs the data signal DS according to the data start signal STH, the polarity control signal POL and the video polarity control signal VPOL.

Figure 4A:
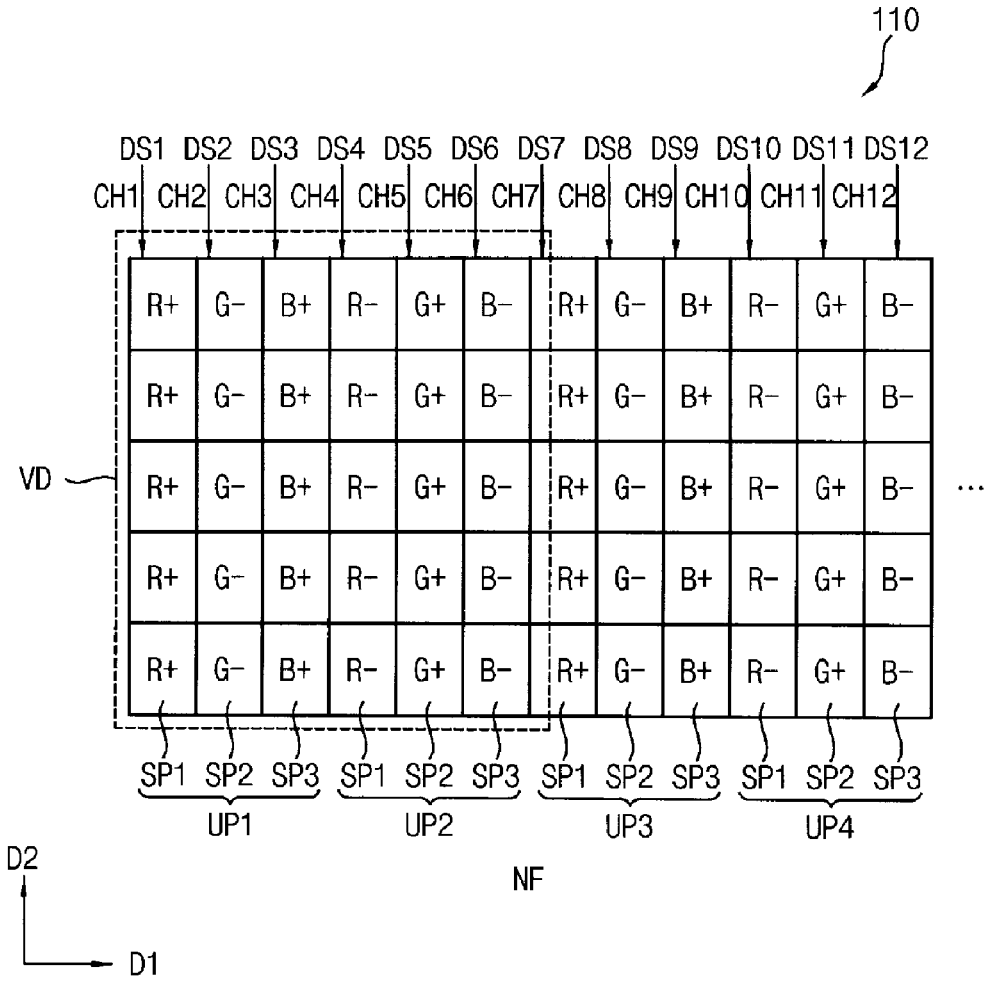
FIGS. 4A, 4B, and 4C are plan views illustrating the display panel displaying a video.
Figure 4B:
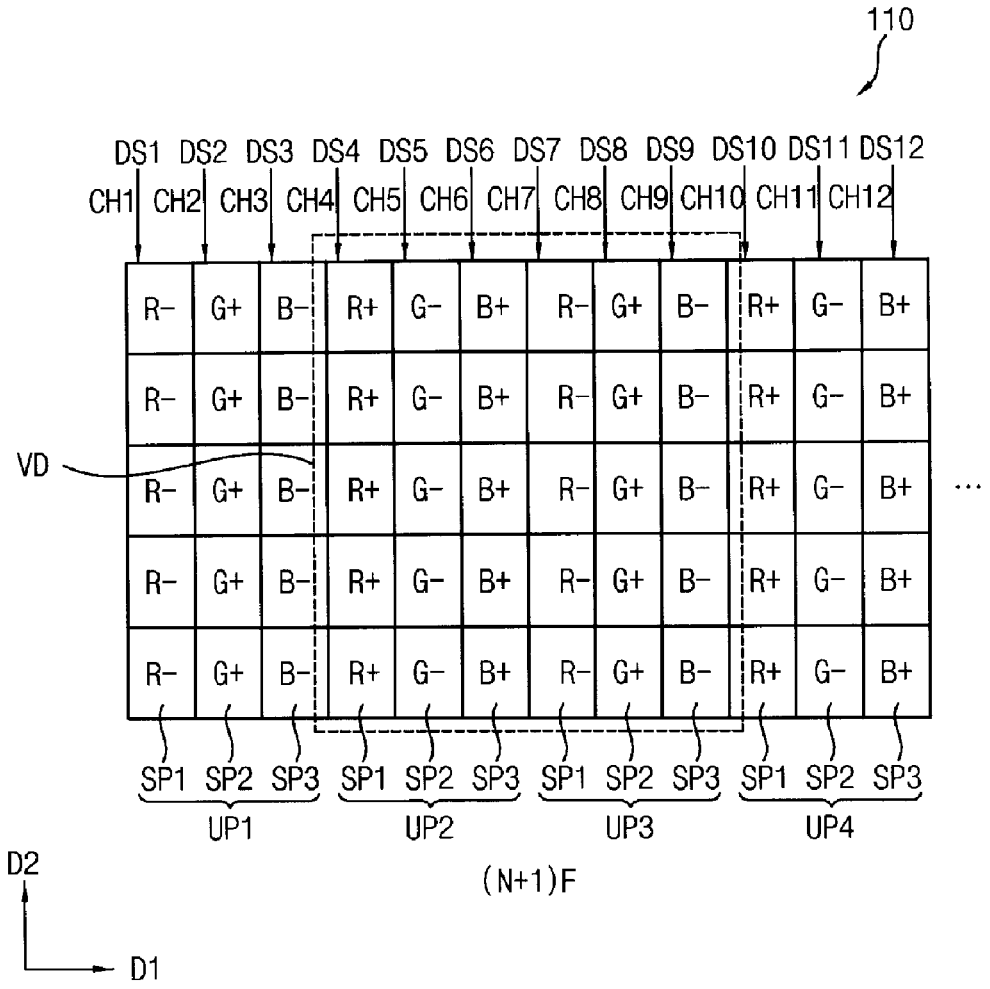
Figure 4C:
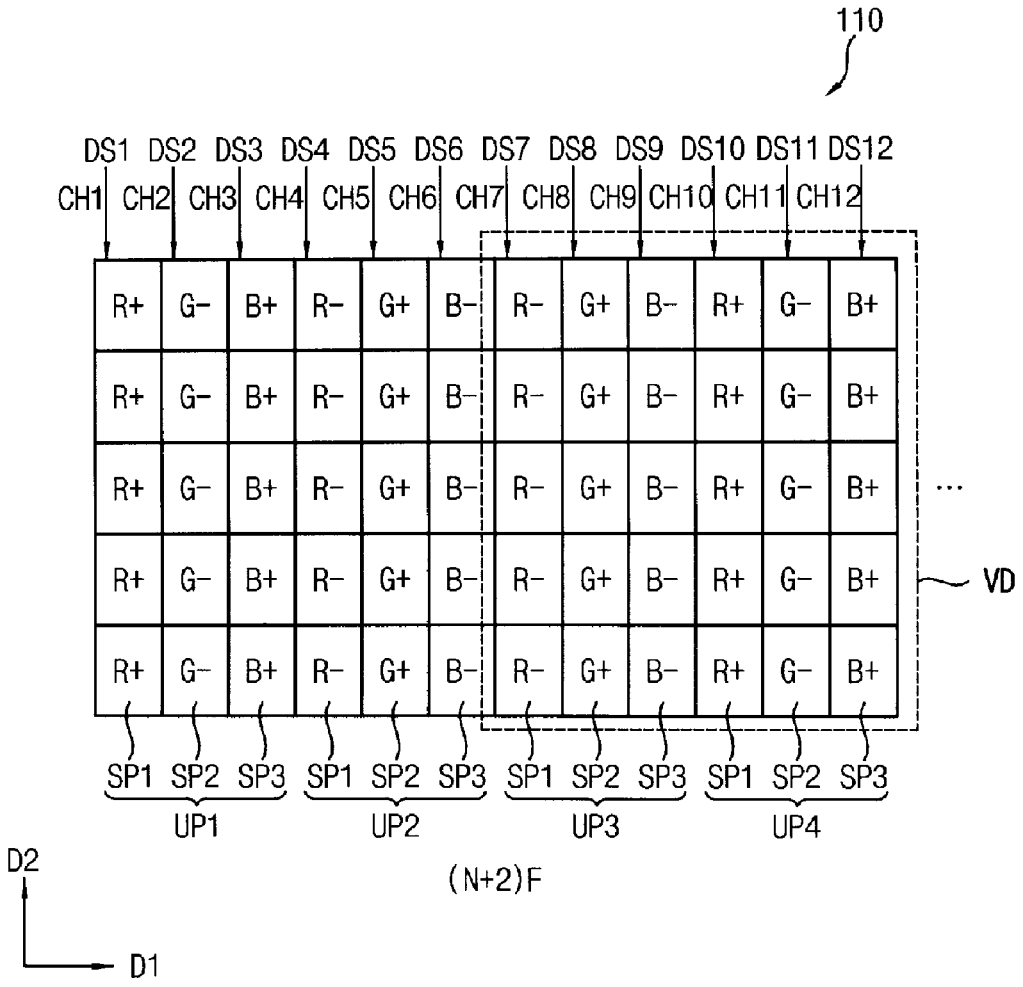

FIGS. 4A, 4B, and 4C are plan views illustrating the display panel 110 displaying the video.

Referring to FIGS. 1, 3, 4A, 4B, and 4C, the display panel 110 may display the video data VD. For example, the video data VD may correspond to a plurality of unit pixels. In addition, the video data VD may move by one unit pixel during one frame in the first direction D1. For example, the video data VD may include data corresponding to the first unit pixel UP1 and the second unit pixel UP2 during the N-th frame NF, the video data VD may include data corresponding to the second unit pixel UP2 and the third unit pixel UP3 during the (N+1)-th frame (N+1)F, and the video data VD may include data corresponding to the third unit pixel UP3 and the fourth unit pixel UP4 during an (N+2)-th frame (N+2)F.

Specifically, the video data VD may be displayed on the display panel 110 by the first to sixth data signals DS1, DS2, . . . , and DS6 during the N-th frame NF. The video data VD may be displayed on the display panel 110 by the fourth to ninth data signals DS4, DS5, . . . , DS9 during the (N+1)-th frame (N+1)F. The video data VD may be displayed on the display panel 110 by the seventh to twelfth data signals DS7, DS8, . . . , DS12 during the (N+2)-th frame (N+2)F.

The video data VD is driven in the column inversion method. The polarities of the data signals DS applied to the display panel 110 are inverted in the frame period, therefore a polarity of the video data VD of the N-th frame NF and a polarity of the video data VD of the (N+1)-th frame (N+1)F are the same. If the polarity of the video data VD of each of frames is the same, a vertical line phenomenon may be occurred on the display panel 110 when the polarity of the video data VD of the (N+1)-th frame (N+1)F and the polarity of the video data VD of the (N+2)-th frame (N+2)F are different from each other. Therefore, the polarities of the data signals DS during the (N+2)-th frame (N+2)F with respect to an area where the video data VD is displayed during the (N+2)-th frame (N+2)F are the same as the polarities of the data signals DS during the (N+1)-th frame (N+1)F. Thus, no frame inversion occurs between the (N+1)-th frame (N+1)F and the (N+2)-th frame (N+2)F with respect to the area where the video data VD is displayed during the (N+2)-th frame (N+2)F.

Figure 5:
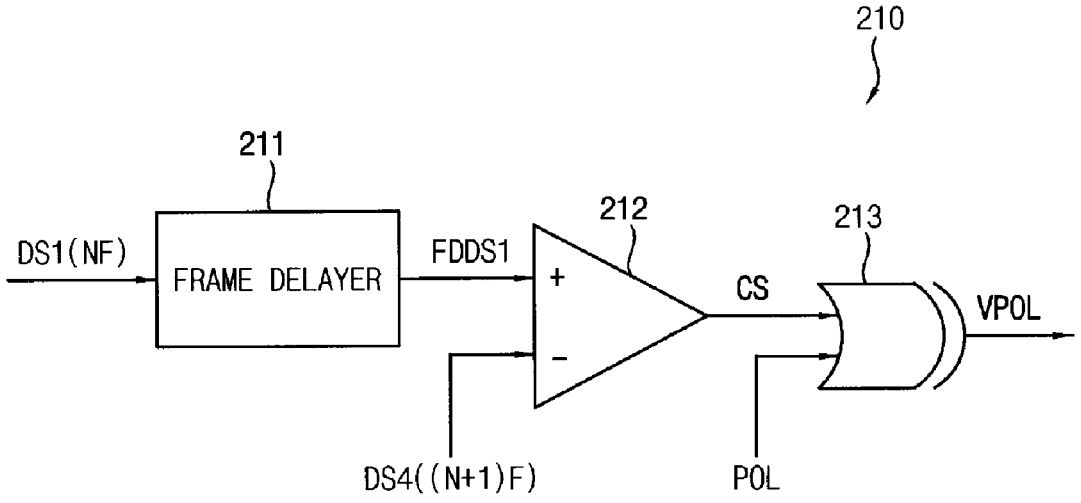
FIG. 5 is a block diagram illustrating a video polarity controlling part of FIG. 3.

FIG. 5 is a block diagram illustrating the video polarity controlling part 210 of FIG. 3.

Referring to FIGS. 1, 3, 4A, 4B, 4C, and 5, the video polarity controlling part 210 includes a frame delayer 211, a comparator 212 and an exclusive or (XOR) operator 213.

The frame delayer 211 receives the first data signal DS1 during the N-th frame NF and delays the first data signal DS1 of the N-th frame NF by one frame to output a frame-delayed first data signal FDDS1.

The comparator 212 receives the frame-delayed first data signal FDDS1 outputted from the frame delayer 211 and the fourth data signal DS4 of the (N+1)-th frame (N+1)F, and compares the frame-delayed first data signal FDDS1 with the fourth data signal DS4 of the (N+1)-th frame (N+1)F to output a comparison signal CS. For example, when the frame-delayed first data signal FDDS1 and the fourth data signal DS4 of the (N+1)-th frame (N+1)F are the same, the comparison signal CS may have a high level, and when the frame-delayed first data signal FDDS1 and the fourth data signal DS4 of the (N+1)-th frame (N+1)F are not the same, the comparison signal CS may have a low level. Specifically, when a polarity of the first data signal DS1 of the N-th frame NF and a polarity of the fourth data signal of the (N+1)-th frame (N+1)F are the same, the comparison signal CS may have the high level, and when the polarity of the first data signal DS1 of the N-th frame NF and the polarity of the fourth data signal of the (N+1)-th frame (N+1)F are not the same, the comparison signal CS may have the low level.

The XOR operator 213 receives the comparison signal CS outputted from the comparator 212 and the polarity control signal POL provided from the timing controlling part 140, and performs an XOR operation on the comparison signal CS and the polarity control signal POL to output the video polarity control signal VPOL. Specifically, when the comparison signal CS is the low level, the video polarity control signal VPOL is substantially the same as the polarity control signal POL, and when the comparison signal CS is the high level, the video polarity control signal VPOL is an inversion signal of the polarity control signal POL.

Figure 6:
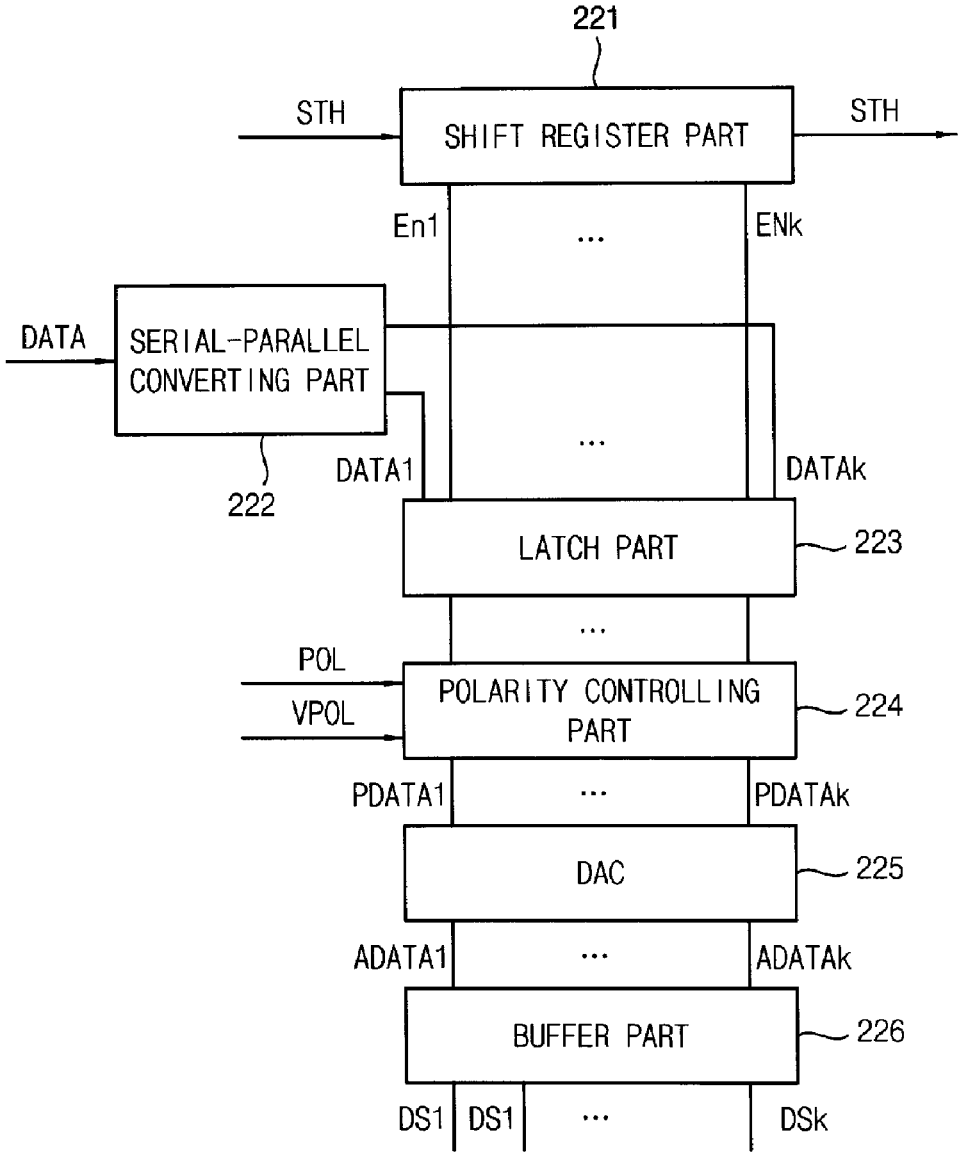
FIG. 6 is a block diagram illustrating a data driving integrated circuit part of FIG. 3.

FIG. 6 is a block diagram illustrating the data driving integrated circuit part 220 of FIG. 3.

Referring to FIGS. 1, 3, 4A, 4B, 4C, 5, and 6, the data driving integrated circuit part 220 includes a shift register part 221, a serial-parallel converting part 222, a latch part 223, a polarity controlling part 224, a digital-analog converting part 225 and a buffer part 226.

The serial-parallel converting part 222 receives the image data DATA and converts the image data DATA to parallel data DATA1, . . . , DATAk.

The shift register part 221 sequentially provides the parallel data DATA1, . . . , DATAk to the latch part 223 while shifting the data start signal STH. Specifically, the shift register 221 sequentially outputs first to k-th enable signals En1, . . . , and Enk to sequentially output the first to k-th parallel data DATA1, . . . , and DATAk to the latch part 223.

The latch part 223 receives the parallel data DATA1, . . . , and DATAk to store the parallel data DATA1, . . . , and DATAk, and outputs the parallel data DATA1, . . . , and DATAk to the polarity controlling part 224.

The polarity controlling part 224 controls polarities of the parallel data DATA1, . . . , and DATAk based on the polarity control signal POL provided from the timing controlling part 140 and the video polarity control signal VPOL provided from the video polarity controlling part 210 to generate polarity data PDATA1, . . . . , and PDATAk, and outputs the polarity data PDATA1, . . . . , and PDATAk to the digital-analog converting part 225.

The digital-analog converting part 225 converts the polarity data PDATA1, . . . . , and PDATAk received from the polarity controlling part 224 into analog data ADATA1, . . . , and ADATAk and outputs the analog data ADATA1, . . . , and ADATAk to the buffer part 226.

The buffer part 226 receives the analog data ADATA1, . . . , and ADATAk, and outputs the analog data ADATA1, . . . , and ADATAk as data signals DS1, . . . , and DSk.

Figure 7A:
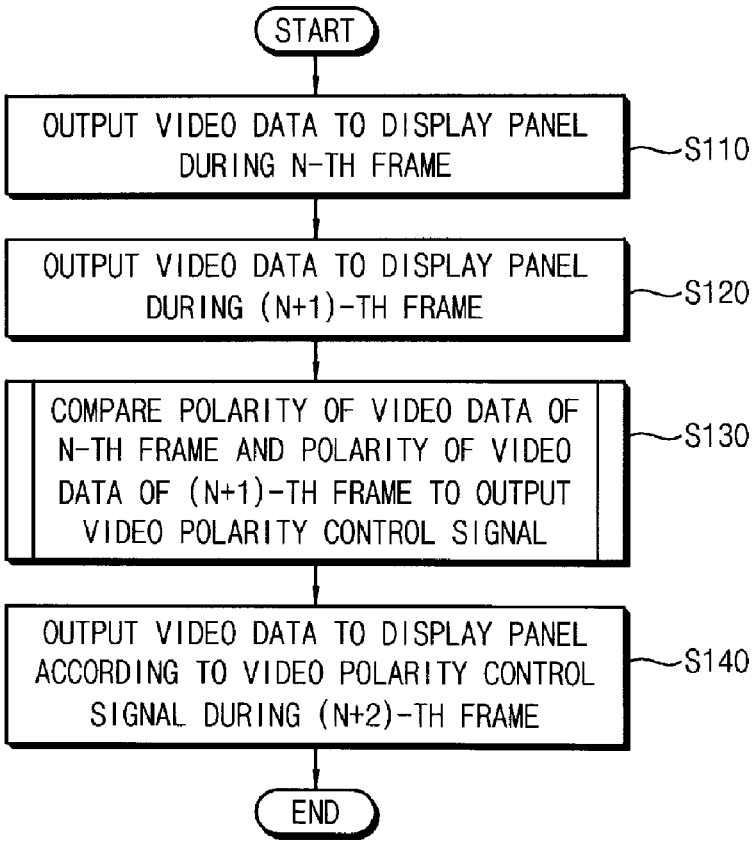
FIGS. 7A and 7B are flow charts illustrating a method of driving a display panel performed by the data driving part of FIG. 1.
Figure 7B:
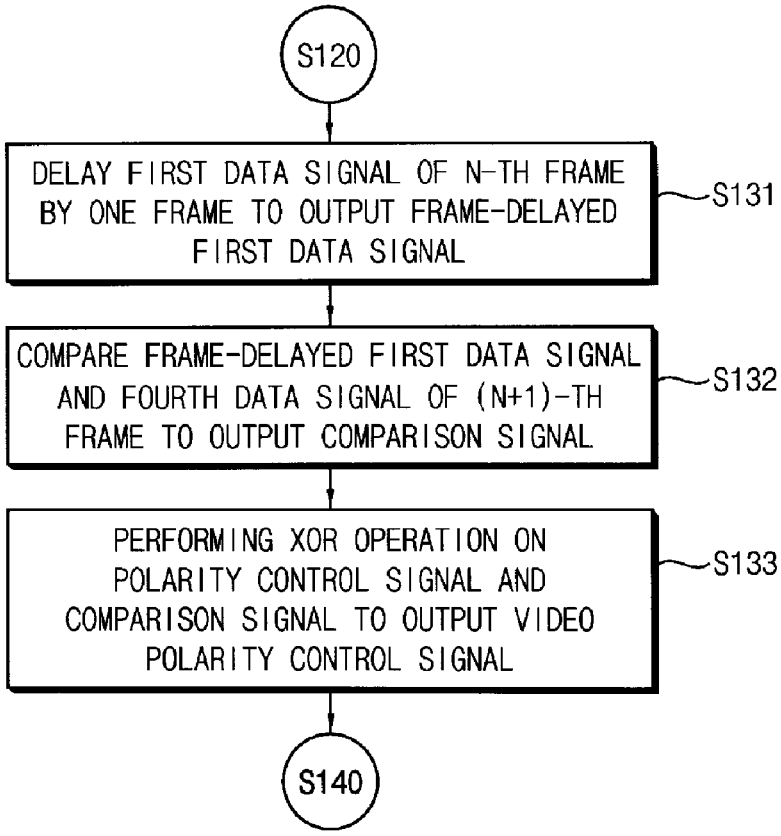

FIGS. 7A and 7B are flow charts illustrating a method of driving a display panel performed by the data driving part 200 of FIG. 1.

Referring to FIGS. 1, 3, 4A, 4B, 4C, 5, 6, 7A, and 7B, the video data VD is outputted to the display panel 110 during the N-th frame NF (step S110). As shown in FIG. 4A, the video data VD may correspond to the first unit pixel UP1 and the second unit pixel UP2 during the N-th frame NF. Thus, the video data VD may be displayed on the display panel 110 by the first to sixth data signals DS1, DS2, . . . , and DS6.

The video data VD is outputted to the display panel 110 during the (N+1)-th frame (N+1)F (step S120). As shown in FIG. 4B, the video data VD may correspond to the second unit pixel UP2 and the third unit pixel UP3 during the (N+1)-th frame (N+1)F. Thus, the video data VD may be displayed on the display panel 110 by the fourth to ninth data signals DS4, DS5, . . . , and DS9.

The polarity of the video data VD of the N-th frame NF and the polarity of the video data VD of the (N+1)-th frame (N+1)F are compared to output the video polarity control signal VPOL (step S130).

Specifically, the first data signal DS1 of the N-th frame NF is delayed by the one frame and the frame-delayed first data signal FDDS1 is outputted (step S131). More specifically, the frame delayer 211 receives the first data signal DS1 during the N-th frame NF and delays the first data signal DS1 of the N-th frame NF by the one frame to output the frame-delayed first data signal FDDS1.

The frame-delayed first data signal FDDS1 and the fourth data signal DS4 of the (N+1)-th frame (N+1)F are compared and the comparison signal CS is outputted (step S132). Specifically, the comparator 212 receives the frame-delayed first data signal FDDS1 outputted from the frame delayer 211 and the fourth data signal DS4 of the (N+1)-th frame (N+1)F, and compares the frame-delayed first data signal FDDS1 with the fourth data signal DS4 of the (N+1)-th frame (N+1)F to output the comparison signal CS. For example, when the frame-delayed first data signal FDDS1 and the fourth data signal DS4 of the (N+1)-th frame (N+1)F are the same, the comparison signal CS may have the high level, and when the frame-delayed first data signal FDDS1 and the fourth data signal DS4 of the (N+1)-th frame (N+1)F are not the same, the comparison signal CS may have the low level. Specifically, when the polarity of the first data signal DS1 of the N-th frame NF and the polarity of the fourth data signal of the (N+1)-th frame (N+1)F are the same, the comparison signal CS may have the high level, and when the polarity of the first data signal DS1 of the N-th frame NF and the polarity of the fourth data signal of the (N+1)-th frame (N+1)F are not the same, the comparison signal CS may have the low level.

The XOR operation on the polarity control signal POL and the comparison signal CS are performed and the video polarity control signal VPOL is outputted (step S133). Specifically, the XOR operator 213 receives the comparison signal CS outputted from the comparator 212 and the polarity control signal POL provided from the timing controlling part 140, and outputs the video polarity control signal VPOL according to the comparison signal CS and the polarity control signal POL. When the comparison signal CS is the low level, the video polarity control signal VPOL is substantially the same as the polarity control signal POL, and when the comparison signal CS is the high level, the video polarity control signal VPOL is the inversion signal of the polarity control signal POL.

The video data VD is outputted to the display panel 110 according to the video polarity control signal VPOL during the (N+2)-th frame (N+2)F (step S140). Specifically, since the polarity of the video data VD of the N-th frame NF and the polarity of the video data VD of the (N+1)-th frame (N+1)F are the same, the video polarity control signal VPOL is the inversion signal of the polarity control signal POL, and no frame inversion occurs between the (N+1)-th frame (N+1)F and the (N+2)-th frame (N+2)F with respect to the area where the video data VD is displayed during the (N+2)-th frame (N+2)F. Therefore, the polarities of the data signals DS during the (N+2)-th frame (N+2)F with respect to the area where the video data VD is displayed during the (N+2)-th frame (N+2)F are the same as the polarities of the data signals DS during the (N+1)-th frame (N+1)F. For example, in case the video data VD is displayed on the display panel 110 by the seventh to twelfth data signals DS7, DS8, . . . , and DS12 during the (N+2)-th frame (N+2)F, polarities of the seventh to twelfth data signals DS7, DS8, . . . , and DS12 during the (N+1)-th frame (N+1)F and polarities of the seventh to twelfth data signals DS7, DS8, . . . , and DS12 during the (N+2)-th frame (N+2)F may be the same.

According to the present exemplary embodiment, the video data VD may have different polarities in adjacent frames, and therefore, the vertical line phenomenon of the display panel 110 may be prevented. Thus, display quality of the display apparatus 100 including the display panel 110 may be improved.

Figure 8A:
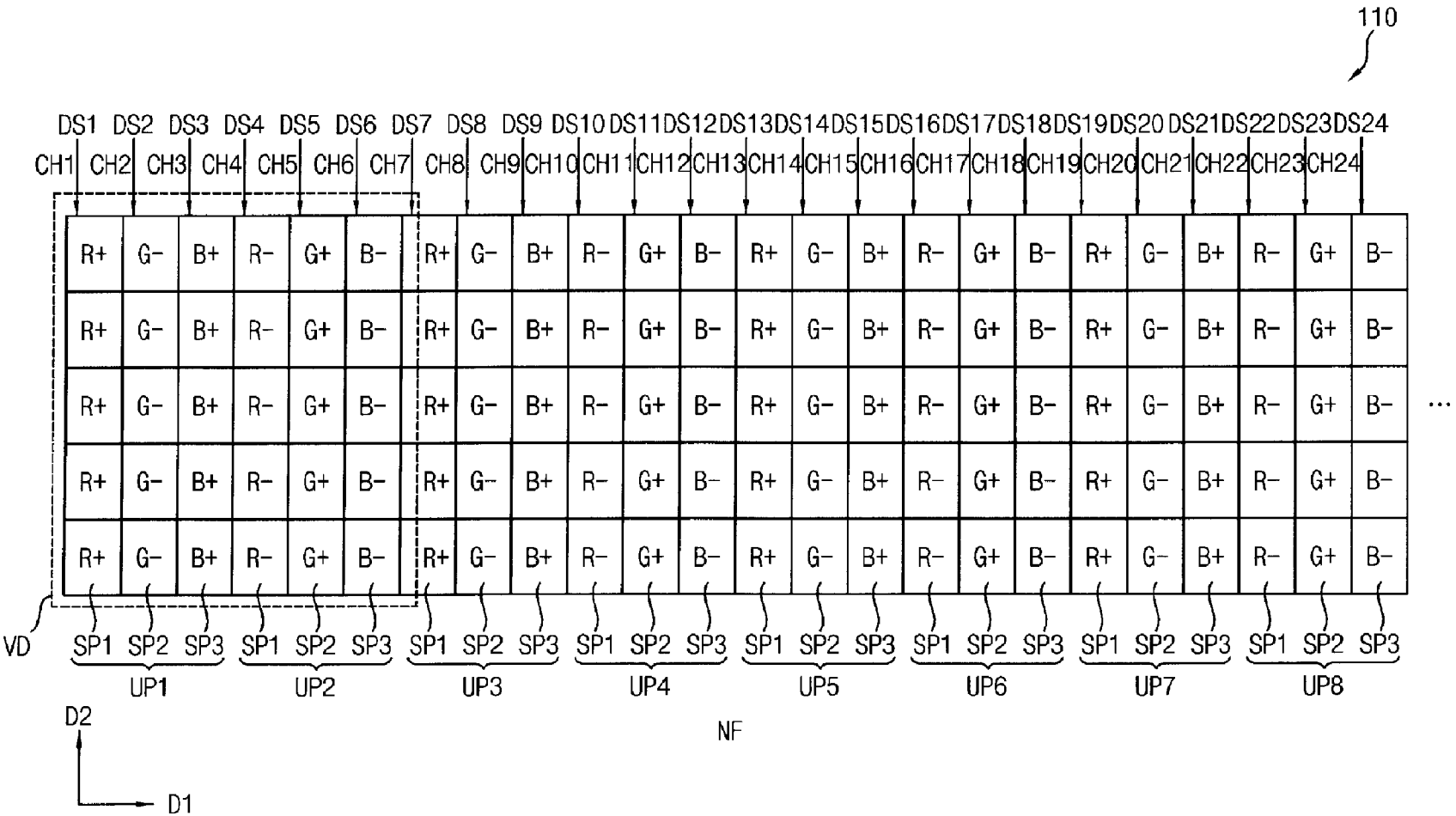
FIGS. 8A, 8B, and 8C are plan views illustrating a display panel displaying a video according to an exemplary embodiment of the present inventive concept.
Figure 8B:
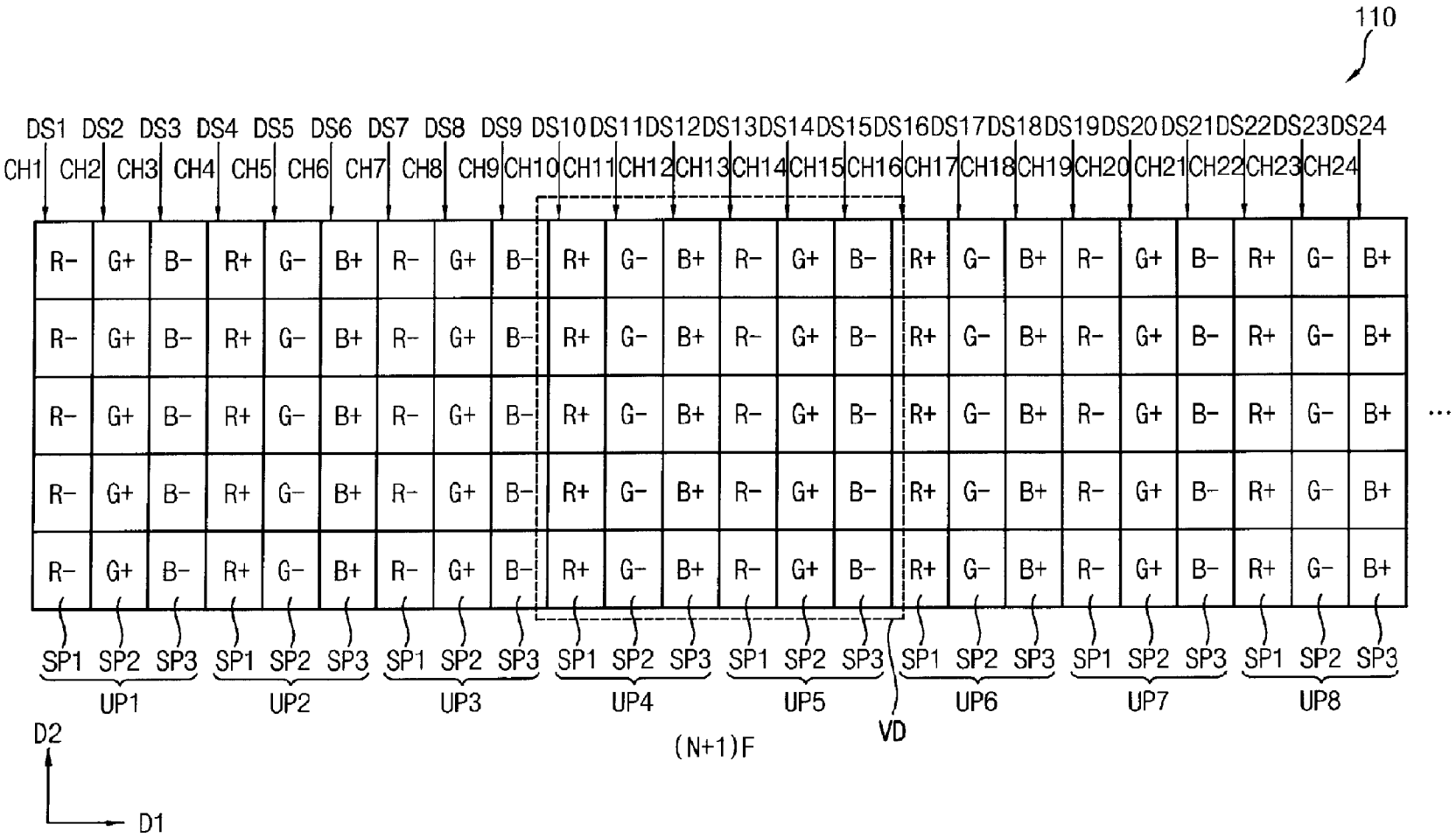
Figure 8C:
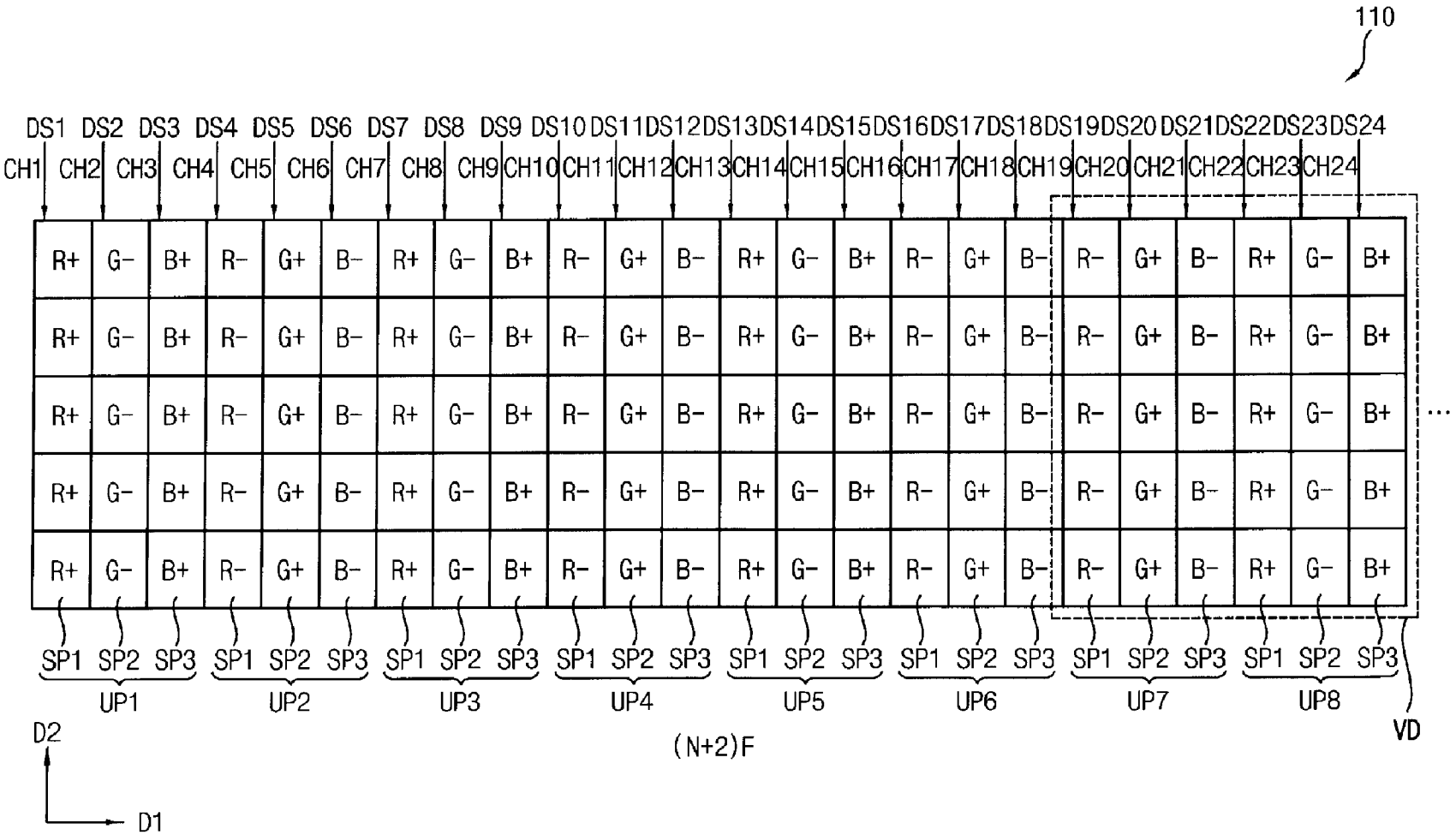
Figure 9:
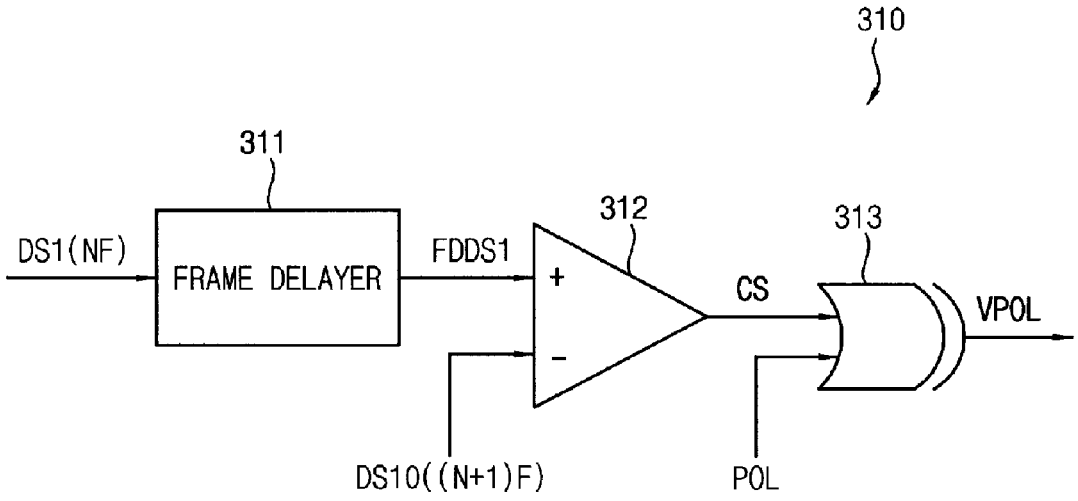
FIG. 9 is a block diagram illustrating a video polarity controlling part controlling a polarity of the video displayed on the display panel of FIGS. 8A to 8C.

FIGS. 8A to 8C are plan views illustrating a display panel displaying a video according to an exemplary embodiment of the present inventive concept, and FIG. 9 is a block diagram illustrating a video polarity controlling part controlling a polarity of the video displayed on the display panel of FIGS. 8A to 8C.

The video polarity controlling part 310 of FIG. 9 according to the present exemplary embodiment may be included in the data driving part 200 according to the previous exemplary embodiment illustrated in FIG. 1. In addition, a data driving part including the video polarity controlling part 310 of FIG. 9 according to the present exemplary embodiment may be substantially the same as the data driving part 200 according to the previous exemplary embodiment illustrated in FIGS. 1 and 3 except for the video polarity controlling part 310. Thus, the same reference numerals will be used to refer to same or like parts as those described in the previous exemplary embodiment and any further repetitive explanation concerning the above elements will be omitted.

Referring to FIGS. 1, 8A, 8B, and 8C, the display panel 110 includes first to eighth unit pixels UP1, UP2, . . . , and UP8, and each of the unit pixels UP1, UP2, . . . , and UP8 includes a first sub pixel SP1, a second sub pixel SP2 and a third sub pixel SP3. Thus, the display panel 110 may receive first to twenty-fourth data signals DS1, DS2, . . . , and DS24 through first to twenty-fourth data channels CH1, CH2, . . . , and CH24. For example, the first sub pixel SP1 may be a red sub pixel, the second sub pixel SP2 may be a green sub pixel and the third sub pixel SP3 may be a blue sub pixel.

The display panel 110 may display a video data VD. For example, the video data VD may correspond to two unit pixels. In addition, the video data VD may move three unit pixels during one frame in the first direction D1. For example, the video data VD may correspond to the first unit pixel UP1 and the second unit pixel UP2 during an N-th frame NF, the video data VD may correspond to the fourth unit pixel UP4 and the fifth unit pixel UP5 during an (N+1)-th frame (N+1)F, and the video data VD may correspond to the seventh unit pixel UP7 and the eighth unit pixel UP8 during an (N+2)-th frame (N+2)F.

Specifically, the video data VD may be displayed on the display panel 110 by the first to sixth data signals DS1, DS2, . . . , and DS6 during the N-th frame NF, the video data VD may be displayed on the display panel 110 by the tenth to fifteenth data signals DS10, DS11, . . . , DS15 during the (N+1)-th frame (N+1)F, and the video data VD may be displayed on the display panel 110 by the nineteenth to twenty-fourth data signals DS19, DS20, . . . , DS24 during the (N+2)-th frame (N+2)F.

The video data VD is driven in the column inversion method. The polarities of the data signals DS applied to the display panel 110 are inverted in the frame period, therefore a polarity of the video data VD of the N-th frame NF and a polarity of the video data VD of the (N+1)-th frame (N+1)F are the same. If the polarity of the video data VD of each of frames is the same, a vertical line phenomenon may be occurred on the display panel 110 when the polarity of the video data VD of the (N+1)-th frame (N+1)F and the polarity of the video data VD of the (N+2)-th frame (N+2)F are different from each other. Therefore, the polarities of the data signals DS during the (N+2)-th frame (N+2)F with respect to an area where the video data VD is displayed during the (N+2)-th frame (N+2)F are the same as the polarities of the data signals DS during the (N+1)-th frame (N+1)F. Thus, no frame inversion occurs between the (N+1)-th frame (N+1)F and the (N+2)-th frame (N+2)F with respect to the area where the video data VD is displayed during the (N+2)-th frame (N+2)F.

Referring to FIG. 9, the video polarity controlling part 310 includes a frame delayer 311, a comparator 312 and an exclusive or (XOR) operator 313.

The frame delayer 311 receives the first data signal DS1 during the N-th frame NF and delays the first data signal DS1 of the N-th frame NF by one frame to output a frame-delayed first data signal FDDS1.

The comparator 312 receives the frame-delayed first data signal FDDS1 outputted from the frame delayer 311 and the tenth data signal DS10 of the (N+1)-th frame (N+1)F, and compares the frame-delayed first data signal FDD with the tenth data signal DS10 of the (N+1)-th frame (N+1)F to output a comparison signal CS. For example, when the frame-delayed first data signal FDDS1 and the tenth data signal DS10 of the (N+1)-th frame (N+1)F are the same, the comparison signal CS may have a high level, and when the frame-delayed first data signal FDDS1 and the tenth data signal DS10 of the (N+1)-th frame (N+1)F are not the same, the comparison signal CS may have a low level. Specifically, when a polarity of the first data signal DS1 of the N-th frame NF and a polarity of the tenth data signal of the (N+1)-th frame (N+1)F are the same, the comparison signal CS may have the high level, and when the polarity of the first data signal DS1 of the N-th frame NF and the polarity of the tenth data signal of the (N+1)-th frame (N+1)F are not the same, the comparison signal CS may have the low level.

The XOR operator 313 receives the comparison signal CS outputted from the comparator 312 and the polarity control signal POL provided from the timing controlling part 140, and performs an XOR operation on the comparison signal CS and the polarity control signal POL to output the video polarity control signal VPOL. Specifically, when the comparison signal CS is the low level, the video polarity control signal VPOL is substantially the same as the polarity control signal POL, and when the comparison signal CS is the high level, the video polarity control signal VPOL is an inversion signal of the polarity control signal POL.

Figure 10A:
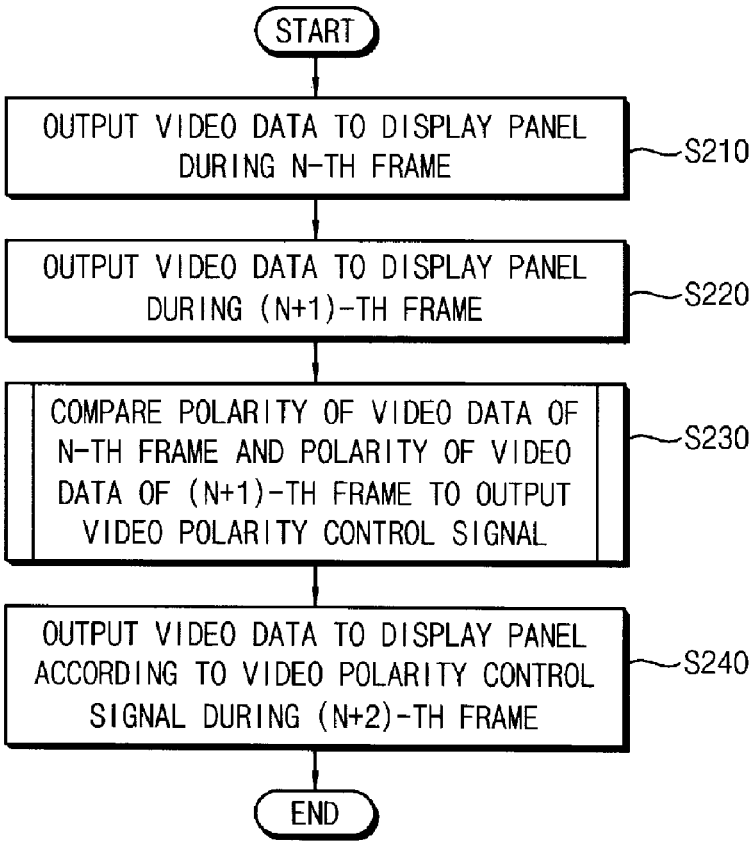
FIGS. 10A and 10B are flow charts illustrating a method of driving a display panel performed by a data driving part including the video polarity controlling part of FIG. 9.
Figure 10B:
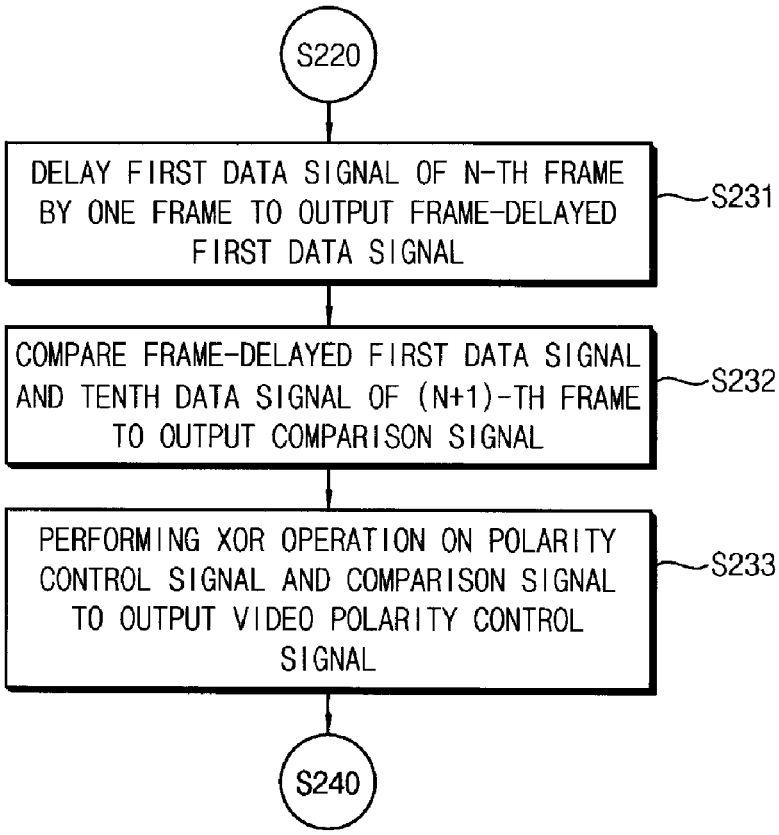

FIGS. 10A and 10B are flow charts illustrating a method of driving a display panel performed by the data driving part including the video polarity controlling part 310 of FIG. 9.

Referring to FIGS. 8A, 8B, 8C, 9, 10A, and 10B, the video data VD is outputted to the display panel 110 during the N-th frame NF (step S210). As shown in FIG. 8A, the video data VD may correspond to the first unit pixel UP1 and the second unit pixel UP2 during the N-th frame NF. Thus, the video data VD may be displayed on the display panel 110 by the first to sixth data signals DS1, DS2, . . . , and DS6.

The video data VD is outputted to the display panel 110 during the (N+1)-th frame (N+1)F (step S220). As shown in FIG. 8B, the video data VD may correspond to the fourth unit pixel UP4 and the fifth unit pixel UP5 during the (N+1)-th frame (N+1)F. Thus, the video data VD may be displayed on the display panel 110 by the tenth to fifteenth data signals DS10, DS11, . . . , and DS15.

The polarity of the video data VD of the N-th frame NF and the polarity of the video data VD of the (N+1)-th frame (N+1)F are compared to output the video polarity control signal VPOL (step S230).

Specifically, the first data signal DS1 of the N-th frame NF is delayed by the one frame and the frame-delayed first data signal FDDS1 is outputted (step S231). More specifically, the frame delayer 211 receives the first data signal DS1 during the N-th frame NF and delays the first data signal DS1 of the N-th frame NF by the one frame to output the frame-delayed first data signal FDDS1.

The frame-delayed first data signal FDDS1 and the tenth data signal DS10 of the (N+1)-th frame (N+1)F are compared and the comparison signal CS is outputted (step S232). Specifically, the comparator 312 receives the frame-delayed first data signal FDDS1 outputted from the frame delayer 311 and the tenth data signal DS10 of the (N+1)-th frame (N+1)F, and compares the frame-delayed first data signal FDDS1 with the tenth data signal DS10 of the (N+1)-th frame (N+1)F to output the comparison signal CS. For example, when the frame-delayed first data signal FDDS1 and the tenth data signal DS10 of the (N+1)-th frame (N+1)F are the same, the comparison signal CS may have the high level, and when the frame-delayed first data signal FDDS1 and the tenth data signal DS10 of the (N+1)-th frame (N+1)F are not the same, the comparison signal CS may have the low level. Specifically, when the polarity of the first data signal DS1 of the N-th frame NF and the polarity of the tenth data signal of the (N+1)-th frame (N+1)F are the same, the comparison signal CS may have the high level, and when the polarity of the first data signal DS1 of the N-th frame NF and the polarity of the tenth data signal of the (N+1)-th frame (N+1)F are not the same, the comparison signal CS may have the low level.

The XOR operation on the polarity control signal POL and the comparison signal CS are performed and the video polarity control signal VPOL is outputted (step S233). Specifically, the XOR operator 313 receives the comparison signal CS outputted from the comparator 312 and the polarity control signal POL provided from the timing controlling part 140, and outputs the video polarity control signal VPOL according to the comparison signal CS and the polarity control signal POL. When the comparison signal CS is the low level, the video polarity control signal VPOL is substantially the same as the polarity control signal POL, and when the comparison signal CS is the high level, the video polarity control signal VPOL is the inversion signal of the polarity control signal POL.

The video data VD is outputted to the display panel 110 according to the video polarity control signal VPOL during the (N+2)-th frame (N+2)F (step S240). Specifically, since the polarity of the video data VD of the N-th frame NF and the polarity of the video data VD of the (N+1)-th frame (N+1)F are the same, the video polarity control signal VPOL is the inversion signal of the polarity control signal POL, and no frame inversion occurs between the (N+1)-th frame (N+1)F and the (N+2)-th frame (N+2)F with respect to the area where the video data VD is displayed during the (N+2)-th frame (N+2)F. Therefore, the polarities of the data signals DS during the (N+2)-th frame (N+2)F with respect to the area where the video data VD is displayed during the (N+2)-th frame (N+2)F are the same as the polarities of the data signals DS during the (N+1)-th frame (N+1)F. For example, in case the video data VD is displayed on the display panel 110 by the nineteenth to twenty-fourth data signals DS19, DS20, . . . , and DS24 during the (N+2)-th frame (N+2)F, polarities of the nineteenth to twenty-fourth data signals DS19, DS20, . . . , and DS24 during the (N+1)-th frame (N+1)F and polarities of the nineteenth to twenty-fourth data signals DS19, DS20, . . . , and DS24 during the (N+2)-th frame (N+2)F may be the same.

In exemplary embodiments, the gate driving part 120, the timing controlling part 140, the data driving part 200, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

According to exemplary embodiments, the features, functions, and/or processes described herein may be implemented via software, hardware (e.g., general processor, digital signal processing (DSP) chip, an application specific integrated circuit (ASIC), field programmable gate arrays (FPGAs), etc.), firmware, or a combination thereof. In this manner, the gate driving part 120, the timing controlling part 140, the data driving part 200, and/or one or more components thereof may include or otherwise be associated with one or more memories (not shown) including code (e.g., instructions) configured to cause the gate driving part 120, the timing controlling part 140, the data driving part 200, and/or one or more components thereof to perform one or more of the features, functions, and/or processes described herein.

The memories may be any medium that participates in providing code/instructions to the one or more software, hardware, and/or firmware components for execution. Such memories may take many forms, including but not limited to non-volatile media, volatile media, and transmission media. Non-volatile media include, for example, optical or magnetic disks. Volatile media include dynamic memory. Transmission media include coaxial cables, copper wire and fiber optics. Transmission media can also take the form of acoustic, optical, or electromagnetic waves. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

In the present exemplary embodiment, each of the first to eighth unit pixels UP1, UP2, . . . , and UP8 includes the three sub pixels SP1, SP2 and SP3, but it is not limited thereto. For example, each of the first to eighth unit pixels UP1, UP2, . . . , and UP8 may include A (A is a natural number) sub pixel.

In addition, in the present exemplary embodiment, the video data VD moves the three unit pixels in the frame period, but it is not limited thereto. For example, the video data VD may move B (B is a natural number) unit pixel.

In addition, in the present exemplary embodiment, the frame delayer 311 delays the first data signal DS to output the frame-delayed first data signal FDDS1, but it is not limited thereto. For example, the frame delayer 311 may delay X-th (X is a natural number) data signal to output a frame-delayed X-th data signal.

In this case, the comparator 312 receives the frame-delayed X-th data signal and an (X+(A*B))-th data signal, and compares the frame-delayed X-th data signal with the (X+(A*B))-th data signal to output the comparison signal CS.

According to the present exemplary embodiment, the video data VD may have different polarities in adjacent frames, therefore the vertical line phenomenon of the display panel 110 may be prevented. Thus, display quality of the display apparatus 100 including the display panel 110 may be improved.

According to the method of driving a display panel, the display panel driving apparatus and the display apparatus having the display panel driving apparatus, a video data may have different polarities in adjacent frames, therefore a vertical line phenomenon of a display panel may be prevented. Thus, display quality of a display apparatus including the display panel may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A method of driving a display panel, the method comprising:

outputting video data to a display panel during an N-th (N is a natural number) frame;

outputting video data to the display panel during an (N+1)-th frame;

comparing polarities of video data of the N-th frame with corresponding polarities of video data of the (N+1)-th frame; and controlling polarities of video data of an (N+2)-th frame, according to the result of the comparison, wherein the display panel comprises a unit pixel comprising A (A is a natural number) sub pixels, wherein the controlling polarities of the video data of the (N+2)-th frame further comprises:

delaying an X-th (X is a natural number) data signal of the N-th frame by one frame to output a frame-delayed X-th data signal;

comparing the frame-delayed X-th data signal with an (X+(A*B))-th (B is a natural number) data signal of the (N+1)-th frame; and outputting a comparison signal based on the result of the comparison, and wherein the B is the number of the unit pixel, which corresponds to a pixel offset between the video data of the N-th frame and the video data of the (N+1)-th frame.

2. The method of claim 1, wherein the polarities of the video data of the (N+2)-th frame is controlled when the polarities of the video data of the N-th frame and the corresponding polarities of the video data of the (N+1)-th frame are the same.

3. The method of claim 2, wherein the polarities of the video data of the (N+2)-th frame are controlled to be different from the corresponding polarities of the video data of the N-th frame and the (N+1)-th frame.

4. The method of claim 1, wherein A is 3 and B is 1.

5. The method of claim 1, wherein A is 3 and B is 3.

6. The method of claim 1, wherein the controlling the polarities of the video data of the (N+2)-th frame further comprises:

operating an exclusive or (XOR) operation on a polarity control signal and the comparison signal to output a video polarity control signal, wherein the display panel is configured to control polarities of a data signal applied to the display panel in response to the polarity control signal, and control the polarities of the video data of the (N+2)-th frame in response to the video polarity control signal.

7. The method of claim 6, wherein the display panel is configured to drive the display panel in a column inversion method in response to the polarity control signal.

8. The method of claim 7, wherein the display panel is configured to invert the polarities of the data signal applied to the display panel in a frame period in response to the polarity control signal.

9. A display panel driving apparatus, comprising:

a gate driver configured to output a gate signal to a gate line of a display panel comprising the gate line and a data line; and a data driver configured to output a video data to the display panel during an N-th (N is a natural number) frame and an (N+1)-th frame, comprising:

a video polarity controller configured to generate a video polarity control signal in response to comparing polarities of the video data of the N-th frame and polarities of the video data of the (N+1)-th frame; and a data driving integrated circuit configured to control polarities of the video data displayed on the display panel during an (N+2)-th frame in response to the video polarity control signal, wherein the display panel comprises a unit pixel comprising A (A is a natural number) sub pixels, wherein the video polarity controller further comprises:

a frame delayer configured to delay an X-th (X is a natural number) data signal of the N-th frame by one frame to output a frame-delayed X-th data signal; and a comparator configured to compare the frame-delayed X-th data signal with an (X+(A*B))-th (B is a natural number) data signal of the (N+1)-th frame to output a comparison signal, and wherein the B is the number of the unit pixel, which corresponds to a pixel offset between the video data of the N-th frame and the video data of the (N+1)-th frame.

10. The display panel driving apparatus of claim 9, wherein the data driver is configured to control the polarities of the video data of the (N+2)-th frame, when the polarities of the video data of the N-th frame and the corresponding polarities of the video data of the (N+1)-th frame are the same.

11. The display panel driving apparatus of claim 10, wherein the data driver is configured to control the polarities of the video data of the (N+2)-th frame to be different from the corresponding polarities of the video data of the N-th frame and the (N+1)-th frame.

12. The display panel driving apparatus of claim 9, wherein A is 3 and B is 1.

13. The display panel driving apparatus of claim 9, wherein A is 3 and B is 3.

14. The display panel driving apparatus of claim 9, wherein the video polarity controller further comprises an exclusive or (XOR) operator configured to operate an exclusive or (XOR) operation on a polarity control signal controlling polarities of the data signal applied to the display panel and the comparison signal to output the video polarity control signal controlling the polarities of the video data of the (N+2)-th frame.

15. The display panel driving apparatus of claim 14, wherein the data driver is configured to drive the display panel in a column inversion method and invert the polarities of the data signals applied to the display panel in a frame period in response to the polarity control signal.

16. A display apparatus, comprising:

a display panel configured to display an image, comprising a gate line and a data line; and a display panel driving apparatus comprising:

a gate driver configured to output a gate signal to the gate line; and a data driver configured to output a video data to the display panel during an N-th (N is a natural number) frame and an (N+1)-th frame, comprising:

a video polarity controller configured to generate a video polarity control signal in response to comparing polarities of the video data of the N-th frame and corresponding polarities of the video data of the (N+1)-th frame; and a data driving integrated circuit configured to control polarities of the video data displayed on the display panel during an (N+2)-th frame in response to the video polarity control signal, wherein the display panel comprises a unit pixel comprising A (A is a natural number) sub pixels, wherein the video polarity controller further comprises:

a frame delayer configured to delay an X-th (X is a natural number) data signal of the N-th frame by one frame to output a frame-delayed X-th data signal; and a comparator configured to compare the frame-delayed X-th data signal with an (X+(A*B))-th (B is a natural number) data signal of the (N+1)-th frame to output a comparison signal, and wherein the B is the number of the unit pixel, which corresponds to a pixel offset between the video data of the N-th frame and the video data of the (N+1)-th frame.

* * * * *